US008479313B2

(12) United States Patent
Jones

(10) Patent No.: US 8,479,313 B2
(45) Date of Patent: Jul. 9, 2013

(54) PROTECTIVE GARMENTS

(75) Inventor: Antony Michael Jones, Atherstone (GB)

(73) Assignee: NP Aerospace Limited, Coventry (GB)

( * ) Notice: Subject to any disclaimer, the term of this patent is extended or adjusted under 35 U.S.C. 154(b) by 1404 days.

(21) Appl. No.: 10/982,688

(22) Filed: Nov. 5, 2004

(65) Prior Publication Data

US 2009/0320170 A1 Dec. 31, 2009

(30) Foreign Application Priority Data

Nov. 7, 2003 (GB) ..... 0326144.3

(51) Int. Cl.
*A41D 13/00* (2006.01)

(52) U.S. Cl.
USPC ..... 2/16

(58) Field of Classification Search
USPC ..... 2/456, 69, 59, 60, 79, 227, 125, 126, 2/16, 44, 45, 22, 24, 911, 457, 458, 81
See application file for complete search history.

(56) References Cited

U.S. PATENT DOCUMENTS

| | | | | |
|---|---|---|---|---|
| 1,385,371 | A | 7/1921 | Fraser | |
| 3,563,836 | A | 2/1971 | Dunbar | |
| 3,832,735 | A * | 9/1974 | Elkins et al. | 2/2.13 |
| 4,151,612 | A * | 5/1979 | Vykukal | 2/2.13 |
| 4,467,475 | A * | 8/1984 | Gregory et al. | 2/462 |
| 4,577,346 | A | 3/1986 | Hall | 2/2 |
| 4,929,478 | A * | 5/1990 | Conaghan et al. | 428/35.1 |
| 5,007,108 | A | 4/1991 | Laberge et al. | 2/2 |
| 5,771,489 | A | 6/1998 | Snedeker | 2/12.5 |
| 5,774,892 | A * | 7/1998 | Tisdale et al. | 2/69 |
| 5,966,739 | A * | 10/1999 | Wagner | 2/23 |
| 6,098,196 | A * | 8/2000 | Logan | 2/2.5 |
| 6,158,056 | A * | 12/2000 | Riley | 2/269 |
| 6,339,843 | B1 * | 1/2002 | Grilliot et al. | 2/97 |
| 6,687,913 | B2 * | 2/2004 | Aldridge | 2/81 |
| 6,826,779 | B1 * | 12/2004 | McKenzie | 2/16 |
| 6,922,847 | B2 * | 8/2005 | Bachner, Jr. | 2/2.5 |
| 7,234,171 | B2 * | 6/2007 | Rowe et al. | 2/114 |
| 7,921,471 | B2 * | 4/2011 | Mordecai et al. | 2/98 |

FOREIGN PATENT DOCUMENTS

| | | |
|---|---|---|
| CA | 2236399 A1 | 10/1999 |
| GB | 105785 | 5/1917 |
| WO | WO 01/39623 A1 | 6/2001 |

* cited by examiner

*Primary Examiner* — Tejash Patel
(74) *Attorney, Agent, or Firm* — Howson & Howson LLP

(57) ABSTRACT

A garment, such a jacket or pair of pants, affords protection from ballistic impacts. The garment comprises at least two tubular sections of strong fabric, the sections overlapping such that said sections can telescope to allow flexing of a body part enclosed thereby without exposing any part of the body part. A set of protective clothing comprises the ballistic protective garment and an outer garment of heat and blast protective material.

10 Claims, 2 Drawing Sheets

PROTECTIVE GARMENTS

BACKGROUND TO THE INVENTION

This invention relates to garments affording protection from ballistic impacts.

It is known to form armor from strong woven fabrics, for example of Aramid® fibers. Such fabrics are stiff and when garments are formed of a thickness giving useful ballistic protection, the wearer can find it extremely difficult to flex his or her joints, particularly the elbows and knees.

SUMMARY OF THE INVENTION

It is an object of the invention to provide armor having a high degree of flexibility.

Accordingly, the invention comprises a protective garment comprising at least two tubular sections of strong fabric, the sections overlapping such that said sections can telescope to allow flexing of a body part enclosed thereby.

Preferably there is always a minimum overlap of at least one inch between adjacent sections around their entire circumference.

The tubular sections may form a sleeve, a body and/or a pant leg of the garment.

As telescoping is generally only required at one side of a body part, e.g. the backs of the elbows or the fronts of the knees, the tubular sections may be directly attached together at a side intended to flex inwardly, for example by sewing. Alternatively or additionally, the tubular sections are attached together by means of a flexible web, for example of bias tape.

In an embodiment of the invention, the tubular sections are covered with an outer layer of strong fabric.

The invention also provides a set of protective clothing comprising a protective garment as defined above and an outer garment of heat and blast protective material. The outer garment ensures that a blast wave does not penetrate between the overlapping sections of the inner protective garment.

BRIEF DESCRIPTION OF THE DRAWINGS

In order that the invention may be more readily understood, a particular embodiment thereof will now be described, by way of example only, with reference to the accompanying drawings, in which.

DETAILED DESCRIPTION OF THE INVENTION

Figure 1:
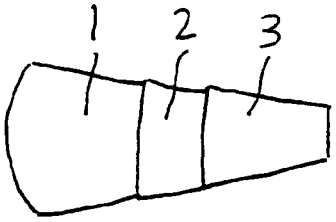
FIG. 1 shows an inner layer of a part of a garment according to the invention.
Figure 2:
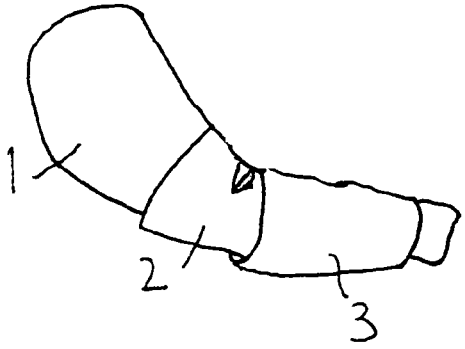
FIG. 2 shows the layer of FIG. 1 on a wearer's arm.

FIGS. 1 and 2 show an inner layer of a sleeve of a jacket. The sleeve is formed from three sections 1, 2, 3 each comprising a tube of strong, ballistic-protective material, e.g. woven aramid fabric. The sections overlap so that the lower end of upper section 1 is received inside the upper end of middle section 2, whilst the lower end of middle section 2 is received inside the upper end of lower section 3. In an alternative embodiment (not shown), upper ends of lower sections are each received inside the lower end of the next section up.

The sections are sewn together along only that part of their circumference which lies on the inside of the wearer's elbow when the jacket is worn. As shown in FIG. 2, the wearer can bend his arm relatively freely, the outer sides of each of the sections 1, 2, 3 telescoping outwardly without exposing any part of the arm. The sleeve as a whole can flex through a wide angle although each of the stiff sections does not have to be flexed to a great extent.

Figure 3:
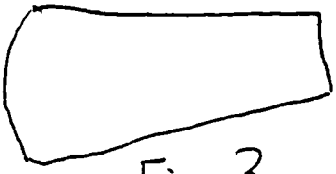
FIG. 3 shows an outer layer for the part of FIG. 1.

FIG. 3 shows an outer layer for the sleeve, which consists of a simple tube, preferably of the same material as that used for the inner layer. We have found that sufficient flexibility can be obtained by forming only one of two layers from telescopic sections.

Figure 5:
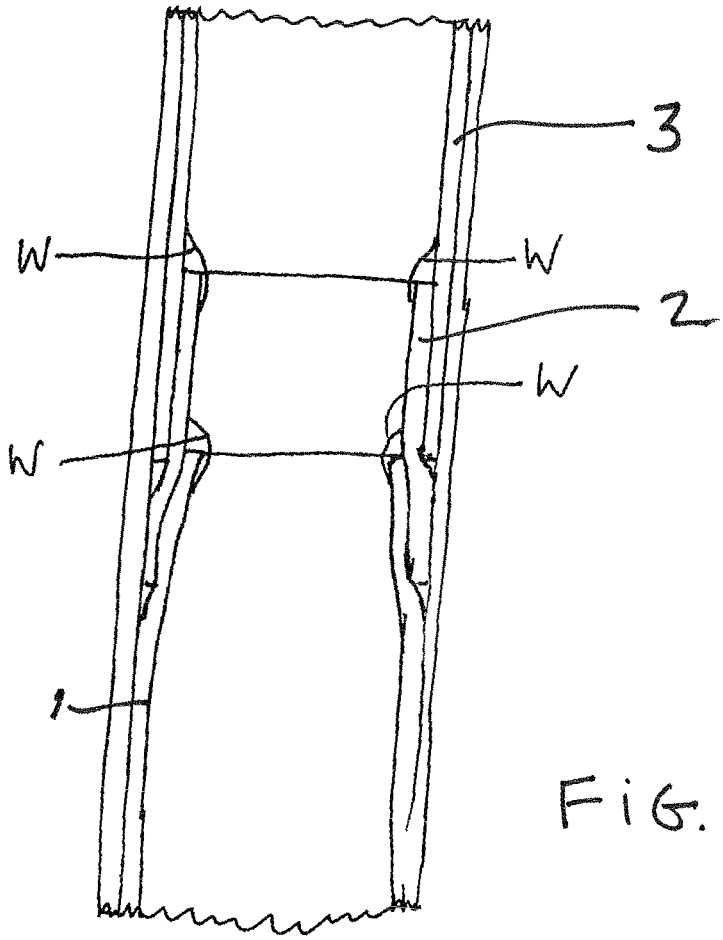
FIG. 5 shows a cross-sectional view of a pant leg of a garment according to the invention.

The inner and outer layers of FIGS. 1 to 3 are both joined to a body portion of a jacket, which can be formed similarly, telescopic sections thereof allowing a wearer's torso to flex. In the same way, pants can be formed allowing flexing at the hips and knees. For example, FIG. 5 illustrates a pant leg 4 including telescopic sections 1, 2 and 3 attached together by means of flexible webs "W".

A further advantage of the greater flexibility of the garments of the invention is that they can be rolled up tightly for storage.

Figure 4:
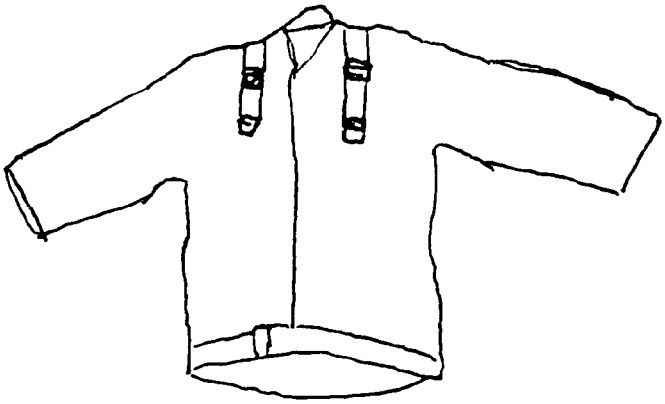
FIG. 4 shows an outer jacket forming part of a set of clothing according to the invention.

For effective protection against ballistic fragments and the like both a jacket and a pair of pants formed in the manner just described are worn. FIG. 4 shows a jacket forming part of a heat and blast resistant suit which can be worn over the ballistic-protective suit. The jacket is formed from a heat resistant material such as Nomex® and ensures that a blast wave does not penetrate overlapping joints of the ballistic-protective jacket. It also serves to retain the parts of the ballistic-protective jacket together. As an alternative to a suit, heat and blast resistant overalls can be provided.

What is claimed is:

1. A set of protective clothing comprising:

a protective garment comprising at least two tubular sections of strong fabric, the at least two tubular sections overlapping at a body joint location of the garment such that the at least two tubular sections can telescope to allow flexing of a body part enclosed thereby without exposing any part of the body part, and an outer garment of heat and blast protective material worn over said protective garment.

2. A set of protective clothing according to claim 1, wherein said strong fabric of said tubular sections is stiff and is formed of a thickness providing ballistic protection.

3. A set of protective clothing according to claim 2, wherein said strong fabric of said tubular sections is a woven aramid fabric.

4. A set of protective clothing according to claim 2, wherein adjacent ones of said tubular sections overlap by at least one inch about an entire circumference of said tubular sections.

5. A set of protective clothing according to claim 1, wherein the tubular sections form a sleeve of the garment.

6. A set of protective clothing according to claim 1, wherein the tubular sections form a body of the garment.

7. A set of protective clothing according to claim 1, wherein the tubular sections form a pant leg of the garment.

8. A set of protective clothing according to claim 1, wherein the tubular sections are directly attached together at a side intended to flex inwardly.

9. A set of protective clothing according to claim 1, wherein the tubular sections are attached together by means of a flexible web.

10. A set of protective clothing according to claim 1, wherein the tubular sections are covered with an outer layer of strong fabric.

* * * * *